US009978359B1

(12) United States Patent
Kaszczuk et al.

(10) Patent No.: US 9,978,359 B1
(45) Date of Patent: May 22, 2018

(54) ITERATIVE TEXT-TO-SPEECH WITH USER FEEDBACK

(71) Applicant: Amazon Technologies, Inc., Reno, NV (US)

(72) Inventors: Michal Tadeusz Kaszczuk, Gdansk (PL); Jeffrey Penrod Adams, Tyngsborough, MA (US); Adam Franciszek Nadolski, Gdansk (PL)

(73) Assignee: Amazon Technologies, Inc., Seattle, WA (US)

( * ) Notice: Subject to any disclaimer, the term of this patent is extended or adjusted under 35 U.S.C. 154(b) by 0 days. days.

(21) Appl. No.: 14/098,677

(22) Filed: Dec. 6, 2013

(51) Int. Cl.
*G10L 13/00* (2006.01)
*G10L 13/02* (2013.01)

(52) U.S. Cl.
CPC ..... *G10L 13/02* (2013.01)

(58) Field of Classification Search
CPC ..... G10L 13/04; G10L 13/00
USPC ..... 704/260
See application file for complete search history.

(56) References Cited

U.S. PATENT DOCUMENTS

2006/0224391 A1* 10/2006 Tamura ..... G10L 13/07 704/268
2008/0167875 A1* 7/2008 Bakis ..... G10L 13/08 704/258
2010/0312565 A1* 12/2010 Wang ..... G10L 13/00 704/260
2011/0313772 A1* 12/2011 Conkie ..... G10L 13/02 704/260
2012/0123782 A1* 5/2012 Wilfart ..... G10L 13/04 704/264
2013/0179170 A1* 7/2013 Cath ..... G10L 13/08 704/260

OTHER PUBLICATIONS

Schroder, Marc; "Emotional Speech Synthesis: A Review"; Dec. 19, 2003; Institue of Phonetics, University of Saarland; p. 1-4.*

* cited by examiner

*Primary Examiner* — Shreyans Patel
(74) *Attorney, Agent, or Firm* — Pierce Atwood LLP

(57) ABSTRACT

A text-to-speech (TTS) processing system may be configured for iterative processing. Speech units for unit selection may be tagged according to extra segmental features, such as emotional features, dramatic features, etc. Preliminary TTS results based on input text may be provided to a user through a user interface. The user may offer corrections to the preliminary results. Those corrections may correspond to the extra segmental features. The user corrections may then be input into the TTS system along with the input text to provide refined TTS results. This process may be repeated iteratively to obtain desired TTS results.

20 Claims, 10 Drawing Sheets

ITERATIVE TEXT-TO-SPEECH WITH USER FEEDBACK

BACKGROUND

Human-computer interactions have progressed to the point where computing devices can render spoken language output to users based on textual sources available to the devices. In such text-to-speech (TTS) systems, a device converts text into an acoustic waveform that is recognizable as speech corresponding to the input text. TTS systems may provide spoken output to users in a number of applications, enabling a user to receive information from a device without necessarily having to rely on tradition visual output devices, such as a monitor or screen. A TTS process may be referred to as speech synthesis or speech generation.

Speech synthesis may be used by computers, hand-held devices, telephone computer systems, kiosks, automobiles, and a wide variety of other devices to improve human-computer interactions.

BRIEF DESCRIPTION OF DRAWINGS

For a more complete understanding of the present disclosure, reference is now made to the following description taken in conjunction with the accompanying drawings.

DETAILED DESCRIPTION

Automated text-to-speech (TTS) systems suffer from a number of drawbacks, including difficulty of a TTS system to mimic natural sounding speech in certain circumstances. Such circumstances include generating speech for long portions of text (called long form narration) as TTS systems do not typically account for variations in a human voice that occur while a person is speaking for an extended period of time. To assist a TTS system with generating natural sounding speech, a TTS system may include a user interface through which a user may alter a first pass of TTS results, allowing the TTS system to make a second pass at synthesized speech using the user input. As described below, the user may alter acoustic features of the first pass of TTS results, may specify particular phonetic units to substitute into the TTS results, or make other edits. The TTS system may then take those user inputs and incorporate them into later iterative passes on the TTS results, thereby improving the eventual TTS output.

Figure 1:
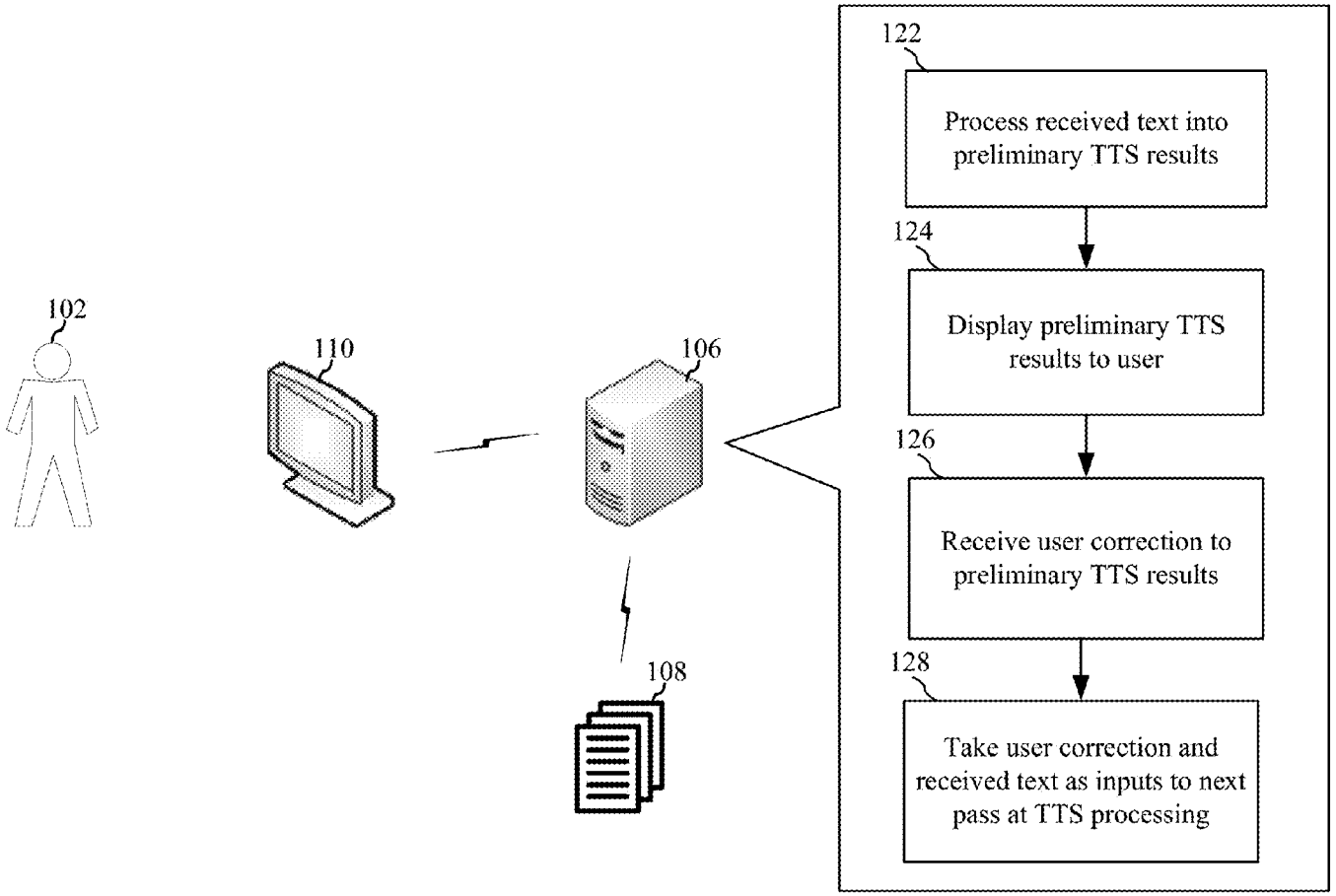
FIG. 1 illustrates generating speech using a user-feedback iterative method according to one aspect of the present disclosure.

Offered is a system and method for improving TTS output by incorporating user feedback into iterative TTS processing. As shown in FIG. 1, a TTS system including device 106 receives text 108 for TTS processing. The TTS system processes the received text 108 into preliminary TTS results, as shown in block 122. The TTS system then displays the preliminary TTS results to a user 102 through a user interface on a display 110, as shown in block 124. The display 110 may be directly connected to device 106 or may be located remotely from device 106, such as on a user device. The user then reviews the preliminary TTS results and corrects an aspect of the preliminary TTS results, such as selecting a new speech unit to be included in the results. The system receives the user correction to the preliminary results, as shown in block 126. The TTS system then takes the user correction and the received text as inputs to a next round of TTS processing, as shown in block 128. This process may then repeat iteratively to achieve desired TTS results. Further details of the customized TTS system are discussed below.

Figure 2:
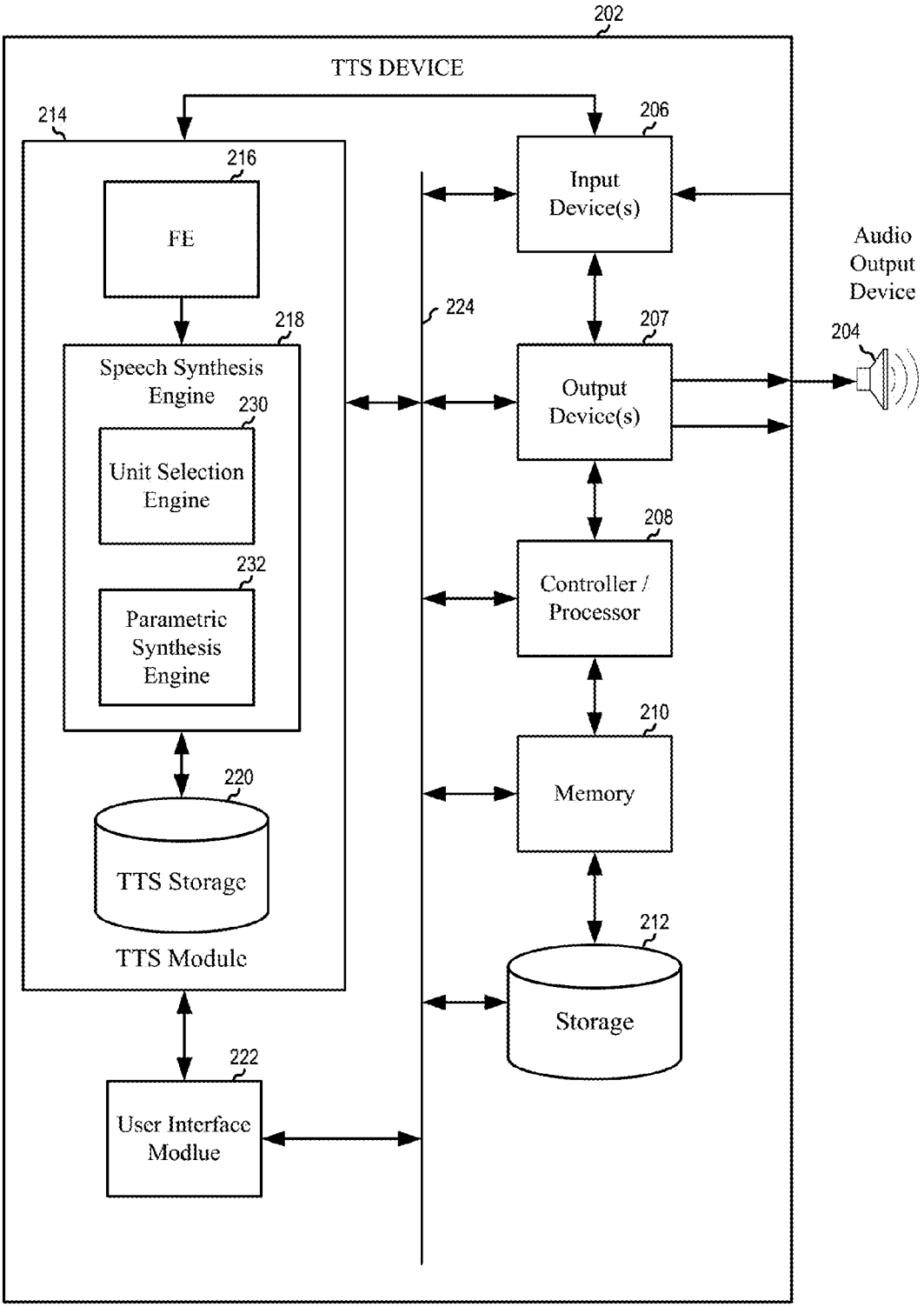
FIG. 2 is a block diagram conceptually illustrating a device for text-to-speech processing according to one aspect of the present disclosure.

FIG. 2 shows a text-to-speech (TTS) device 202 for performing speech synthesis. Aspects of the present disclosure include computer-readable and computer-executable instructions that may reside on the TTS device 202. FIG. 2 illustrates a number of components that may be included in the TTS device 202, however other non-illustrated components may also be included. Also, some of the illustrated components may not be present in every device capable of employing aspects of the present disclosure. Further, some components that are illustrated in the TTS device 202 as a single component may also appear multiple times in a single device. For example, the TTS device 202 may include multiple input devices 206, output devices 207 or multiple controllers/processors 208.

Multiple TTS devices may be employed in a single speech synthesis system. In such a multi-device system, the TTS devices may include different components for performing different aspects of the speech synthesis process. The multiple devices may include overlapping components. The TTS device as illustrated in FIG. 2 is exemplary, and may be a stand-alone device or may be included, in whole or in part, as a component of a larger device or system.

The teachings of the present disclosure may be applied within a number of different devices and computer systems, including, for example, general-purpose computing systems, server-client computing systems, mainframe computing systems, telephone computing systems, laptop computers, cellular phones, personal digital assistants (PDAs), tablet computers, other mobile devices, etc. The TTS device 202 may also be a component of other devices or systems that may provide speech recognition functionality such as automated teller machines (ATMs), kiosks, global position systems (GPS), home appliances (such as refrigerators, ovens, etc.), vehicles (such as cars, buses, motorcycles, etc.), and/or ebook readers, for example.

As illustrated in FIG. 2, the TTS device 202 may include an audio output device 204 for outputting speech processed by the TTS device 202 or by another device. The audio output device 204 may include a speaker, headphone, or other suitable component for emitting sound. The audio output device 204 may be integrated into the TTS device 202 or may be separate from the TTS device 202. The TTS device 202 may also include an address/data bus 224 for conveying data among components of the TTS device 202. Each component within the TTS device 202 may also be directly connected to other components in addition to (or instead of) being connected to other components across the bus 224. Although certain components are illustrated in FIG. 2 as directly connected, these connections are illustrative only and other components may be directly connected to each other (such as the TTS module 214 to the controller/processor 208).

The TTS device 202 may include a controller/processor 208 that may be a central processing unit (CPU) for processing data and computer-readable instructions and a memory 210 for storing data and instructions. The memory 210 may include volatile random access memory (RAM), non-volatile read only memory (ROM), and/or other types of memory. The TTS device 202 may also include a data storage component 212, for storing data and instructions. The data storage component 212 may include one or more storage types such as magnetic storage, optical storage, solid-state storage, etc. The TTS device 202 may also be connected to removable or external memory and/or storage (such as a removable memory card, memory key drive, networked storage, etc.) through the input device 206 or output device 207. Computer instructions for processing by the controller/processor 208 for operating the TTS device 202 and its various components may be executed by the controller/processor 208 and stored in the memory 210, storage 212, external device, or in memory/storage included in the TTS module 214 discussed below. Alternatively, some or all of the executable instructions may be embedded in hardware or firmware in addition to or instead of software. The teachings of this disclosure may be implemented in various combinations of software, firmware, and/or hardware, for example.

The TTS device 202 includes input device(s) 206 and output device(s) 207. A variety of input/output device(s) may be included in the device. Example input devices include an audio output device 204, such as a microphone, a touch input device, keyboard, mouse, stylus or other input device. Example output devices include a visual display, tactile display, audio speakers (pictured as a separate component), headphones, printer or other output device. The input device(s) 206 and/or output device(s) 207 may also include an interface for an external peripheral device connection such as universal serial bus (USB), FireWire, Thunderbolt or other connection protocol. The input device(s) 206 and/or output device(s) 207 may also include a network connection such as an Ethernet port, modem, etc. The input device(s) 206 and/or output device(s) 207 may also include a wireless communication device, such as radio frequency (RF), infrared, Bluetooth, wireless local area network (WLAN) (such as WiFi), or wireless network radio, such as a radio capable of communication with a wireless communication network such as a Long Term Evolution (LTE) network, WiMAX network, 3G network, etc. Through the input device(s) 206 and/or output device(s) 207 the TTS device 202 may connect to a network, such as the Internet or private network, which may include a distributed computing environment.

The device may also include an TTS module 214 for processing textual data into audio waveforms including speech. The TTS module 214 may be connected to the bus 224, input device(s) 206, output device(s) 207, audio output device 204, controller/processor 208 and/or other component of the TTS device 202. The textual data may originate from an internal component of the TTS device 202 or may be received by the TTS device 202 from an input device such as a keyboard or may be sent to the TTS device 202 over a network connection. The text may be in the form of sentences including text, numbers, and/or punctuation for conversion by the TTS module 214 into speech. The input text may also include special annotations for processing by the TTS module 214 to indicate how particular text is to be pronounced when spoken aloud. Textual data may be processed in real time or may be saved and processed at a later time.

The TTS module 214 includes a TTS front end (FE) 216, a speech synthesis engine 218, and TTS storage 220. The FE 216 transforms input text data into a symbolic linguistic representation for processing by the speech synthesis engine 218. The speech synthesis engine 218 compares the annotated phonetic units models and information stored in the TTS storage 220 for converting the input text into speech. The FE 216 and speech synthesis engine 218 may include their own controller(s)/processor(s) and memory or they may use the controller/processor 208 and memory 210 of the TTS device 202, for example. Similarly, the instructions for operating the FE 216 and speech synthesis engine 218 may be located within the TTS module 214, within the memory 210 and/or storage 212 of the TTS device 202, or within an external device.

Text input into a TTS module 214 may be sent to the FE 216 for processing. The front-end may include modules for performing text normalization, linguistic analysis, and linguistic prosody generation. During text normalization, the FE processes the text input and generates standard text, converting such things as numbers, abbreviations (such as Apt., St., etc.), symbols ($, %, etc.) into the equivalent of written out words.

During linguistic analysis the FE 216 analyzes the language in the normalized text to generate a sequence of phonetic units corresponding to the input text. This process may be referred to as phonetic transcription. Phonetic units include symbolic representations of sound units to be eventually combined and output by the TTS device 202 as speech. Various sound units may be used for dividing text for purposes of speech synthesis. A TTS module 214 may process speech based on phonemes (individual sounds), half-phonemes, di-phones (the last half of one phoneme coupled with the first half of the adjacent phoneme), bi-phones (two consecutive phonemes), syllables, words, phrases, sentences, or other units. Each word may be mapped to one or more phonetic units. Such mapping may be performed using a language dictionary stored in the TTS device 202, for example in the TTS storage module 220. The linguistic analysis performed by the FE 216 may also identify different grammatical components such as prefixes, suffixes, phrases, punctuation, syntactic boundaries, or the like. Such grammatical components may be used by the TTS module 214 to craft a natural sounding audio waveform output. The language dictionary may also include letter-to-sound rules and other tools that may be used to pronounce previously unidentified words or letter combinations that may be encountered by the TTS module 214. Generally, the more information included in the language dictionary, the higher quality the speech output.

Based on the linguistic analysis the FE 216 may then perform linguistic prosody generation where the phonetic units are annotated with desired prosodic characteristics, also called acoustic features, which indicate how the desired phonetic units are to be pronounced in the eventual output speech. During this stage the FE 216 may consider and incorporate any prosodic annotations that accompanied the text input to the TTS module 214. Such acoustic features may include pitch, energy, duration, and the like. Application of acoustic features may be based on prosodic models available to the TTS module 214. Such prosodic models indicate how specific phonetic units are to be pronounced in certain circumstances. A prosodic model may consider, for example, a phoneme's position in a syllable, a syllable's position in a word, a word's position in a sentence or phrase, neighboring phonetic units, etc. As with the language dictionary, prosodic model with more information may result in higher quality speech output than prosodic models with less information.

The output of the FE 216, referred to as a symbolic linguistic representation, may include a sequence of phonetic units annotated with prosodic characteristics. This symbolic linguistic representation may be sent to a speech synthesis engine 218, also known as a synthesizer, for conversion into an audio waveform of speech for output to an audio output device 204 and eventually to a user. The speech synthesis engine 218 may be configured to convert the input text into high-quality natural-sounding speech in an efficient manner. Such high-quality speech may be configured to sound as much like a human speaker as possible, or may be configured to be understandable to a listener without attempts to mimic a precise human voice.

A speech synthesis engine 218 may perform speech synthesis using one or more different methods. In one method of synthesis called unit selection, described further below, a unit selection engine 230 matches a database of recorded speech against the symbolic linguistic representation created by the FE 216. The unit selection engine 230 matches the symbolic linguistic representation against spoken audio units in the database. Matching units are selected and concatenated together to form a speech output. Each unit includes an audio waveform corresponding with a phonetic unit, such as a short .wav file of the specific sound, along with a description of the various acoustic features associated with the .wav file (such as its pitch, energy, etc.), as well as other information, such as where the phonetic unit appears in a word, sentence, or phrase, the neighboring phonetic units, etc. Using all the information in the unit database, a unit selection engine 230 may match units to the input text to create a natural sounding waveform. The unit database may include multiple examples of phonetic units to provide the TTS device 202 with many different options for concatenating units into speech. One benefit of unit selection is that, depending on the size of the database, a natural sounding speech output may be generated. The larger the unit database, the more likely the TTS device 202 will be able to construct natural sounding speech.

In another method of synthesis called parametric synthesis parameters such as frequency, volume, noise, are varied by a parametric synthesis engine 232, digital signal processor or other audio generation device to create an artificial speech waveform output. Parametric synthesis may use an acoustic model and various statistical techniques to match a symbolic linguistic representation with desired output speech parameters. Parametric synthesis may include the ability to be accurate at high processing speeds, as well as the ability to process speech without large databases associated with unit selection, but also typically produces an output speech quality that may not match that of unit selection. Unit selection and parametric techniques may be performed individually or combined together and/or combined with other synthesis techniques to produce speech audio output.

Parametric speech synthesis may be performed as follows. A TTS module 214 may include an acoustic model, or other models, which may convert a symbolic linguistic representation into a synthetic acoustic waveform of the text input based on audio signal manipulation. The acoustic model includes rules which may be used by the parametric synthesis engine 232 to assign specific audio waveform parameters to input phonetic units and/or prosodic annotations. The rules may be used to calculate a score representing a likelihood that a particular audio output parameter(s) (such as frequency, volume, etc.) corresponds to the portion of the input symbolic linguistic representation from the FE 216.

The parametric synthesis engine 232 may use a number of techniques to match speech to be synthesized with input phonetic units and/or prosodic annotations. One common technique is using Hidden Markov Models (HMMs). HMMs may be used to determine probabilities that audio output should match textual input. HMMs may be used to translate from parameters from the linguistic and acoustic space to the parameters to be used by a vocoder (a digital voice encoder) to artificially synthesize the desired speech. Using HMMs, a number of states are presented, in which the states together represent one or more potential acoustic parameters to be output to the vocoder and each state is associated with a model, such as a Gaussian mixture model. Transitions between states may also have an associated probability, representing a likelihood that a current state may be reached from a previous state. Sounds to be output may be represented as paths between states of the HMM and multiple paths may represent multiple possible audio matches for the same input text. Each portion of text may be represented by multiple potential states corresponding to different known pronunciations of phonemes and their parts (such as the phoneme identity, stress, accent, position, etc.). An initial determination of a probability of a potential phoneme may be associated with one state. As new text is processed by the speech synthesis engine 218, the state may change or stay the same, based on the processing of the new text. For example, the pronunciation of a previously processed word might change based on later processed words. A Viterbi algorithm may be used to find the most likely sequence of states based on the processed text. The HMMs may generate speech in parametrized form including parameters such as fundamental frequency (f0), noise envelope, spectral envelope, etc. that are translated by a vocoder into audio segments. The output parameters may be configured for particular vocoders such as a STRAIGHT vocoder, TANDEM-STRAIGHT vocoder, HNM (harmonic plus noise) based vocoders, CELP (code-excited linear prediction) vocoders, GlottHMM vocoders, HSM (harmonic/stochastic model) vocoders, or others.

Figure 3:
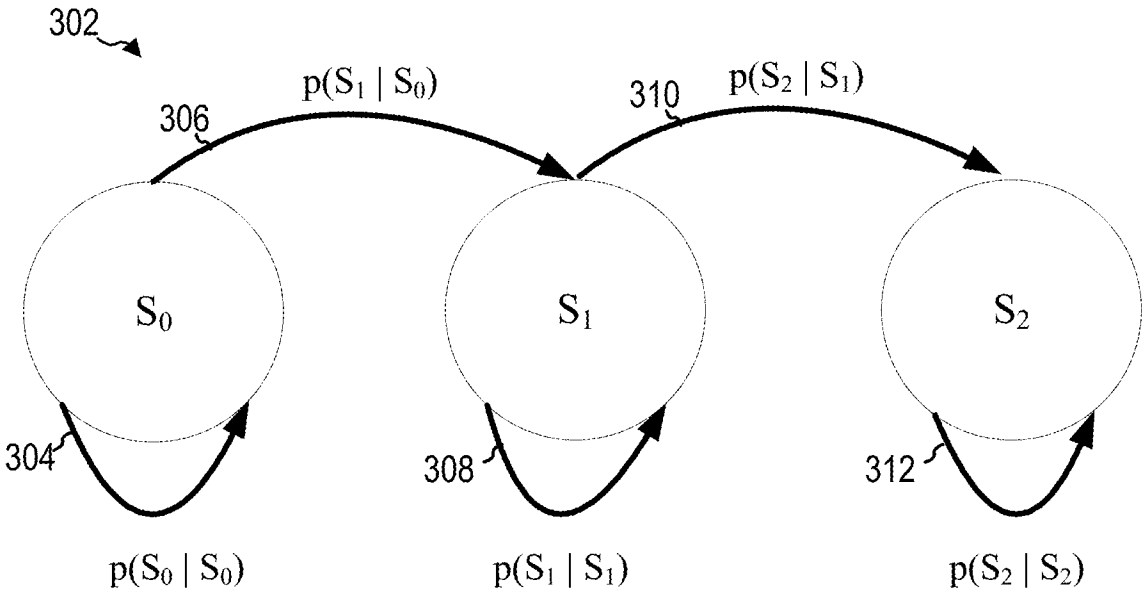
FIG. 3 illustrates speech synthesis using a Hidden Markov Model according to one aspect of the present disclosure.

An example of HMM processing for speech synthesis is shown in FIG. 3. A sample input phonetic unit, for example, phoneme /E/, may be processed by a parametric synthesis engine 232. The parametric synthesis engine 232 may initially assign a probability that the proper audio output associated with that phoneme is represented by state $S_0$ in the Hidden Markov Model illustrated in FIG. 3. After further processing, the speech synthesis engine 218 determines whether the state should either remain the same, or change to a new state. For example, whether the state should remain the same 304 may depend on the corresponding transition probability (written as $P(S_0|S_0)$, meaning the probability of going from state $S_0$ to $S_0$) and how well the subsequent frame matches states $S_0$ and $S_1$. If state $S_1$ is the most probable, the calculations move to state $S_1$ and continue from there. For subsequent phonetic units, the speech synthesis engine 218 similarly determines whether the state should remain at $S_1$, using the transition probability represented by $P(S_1|S_1)$ 308, or move to the next state, using the transition probability $P(S_2|S_1)$ 310. As the processing continues, the parametric synthesis engine 232 continues calculating such probabilities including the probability 312 of remaining in state $S_2$ or the probability of moving from a state of illustrated phoneme /E/ to a state of another phoneme. After processing the phonetic units and acoustic features for state $S_2$, the speech recognition may move to the next phonetic unit in the input text.

The probabilities and states may be calculated using a number of techniques. For example, probabilities for each state may be calculated using a Gaussian model, Gaussian mixture model, or other technique based on the feature vectors and the contents of the TTS storage 220. Techniques such as maximum likelihood estimation (MLE) may be used to estimate the probability of particular states.

In addition to calculating potential states for one audio waveform as a potential match to a phonetic unit, the parametric synthesis engine 232 may also calculate potential states for other potential audio outputs (such as various ways of pronouncing phoneme /E/) as potential acoustic matches for the phonetic unit. In this manner multiple states and state transition probabilities may be calculated.

The probable states and probable state transitions calculated by the parametric synthesis engine 232 may lead to a number of potential audio output sequences. Based on the acoustic model and other potential models, the potential audio output sequences may be scored according to a confidence level of the parametric synthesis engine 232. The highest scoring audio output sequence, including a stream of parameters to be synthesized, may be chosen and digital signal processing may be performed by a vocoder or similar component to create an audio output including synthesized speech waveforms corresponding to the parameters of the highest scoring audio output sequence and, if the proper sequence was selected, also corresponding to the input text.

Unit selection speech synthesis may be performed as follows. Unit selection includes a two-step process. First a unit selection engine 230 determines what speech units to use and then it combines them so that the particular combined units match the desired phonemes and acoustic features and create the desired speech output. Units may be selected based on a cost function which represents how well particular units fit the speech segments to be synthesized. The cost function may represent a combination of different costs representing different aspects of how well a particular speech unit may work for a particular speech segment. For example, a target cost indicates how well a given speech unit matches the features of a desired speech output (e.g., pitch, prosody, etc.). A join cost represents how well a speech unit matches a consecutive speech unit for purposes of concatenating the speech units together in the eventual synthesized speech. The overall cost function is a combination of target cost, join cost, and other costs that may be determined by the unit selection engine 230. As part of unit selection, the unit selection engine 230 chooses the speech unit with the lowest overall combined cost. For example, a speech unit with a very low target cost may not necessarily be selected if its join cost is high.

A TTS device 202 may be configured with a speech unit database for use in unit selection. The speech unit database may be stored in TTS storage 220, in storage 212, or in another storage component. The speech unit database includes recorded speech utterances with the utterances' corresponding text aligned to the utterances. The speech unit database may include many hours of recorded speech (in the form of audio waveforms, feature vectors, or other formats), which may occupy a significant amount of storage in the TTS device 202. The unit samples in the speech unit database may be classified in a variety of ways including by phonetic unit (phoneme, diphone, word, etc.), linguistic prosodic label, acoustic feature sequence, speaker identity, etc. The sample utterances may be used to create mathematical models corresponding to desired audio output for particular speech units. When matching a symbolic linguistic representation the speech synthesis engine 218 may attempt to select a unit in the speech unit database that most closely matches the input text (including both phonetic units and prosodic annotations). Generally the larger the speech unit database the better the speech synthesis may be achieved by virtue of the greater number of unit samples that may be selected to form the precise desired speech output.

Figure 4A:
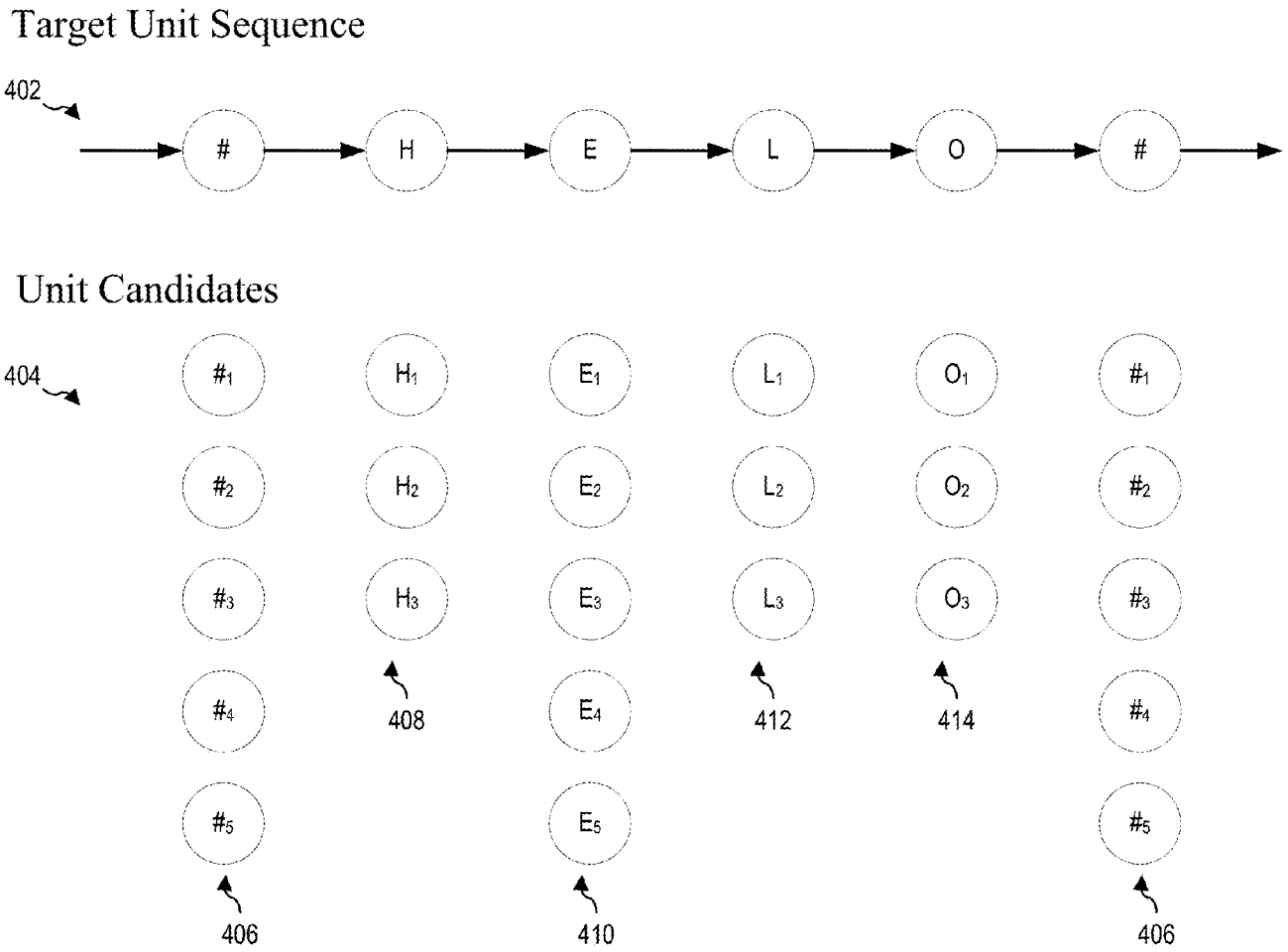
FIGS. 4A-4B illustrate speech synthesis using unit selection according to one aspect of the present disclosure.
Figure 4B:
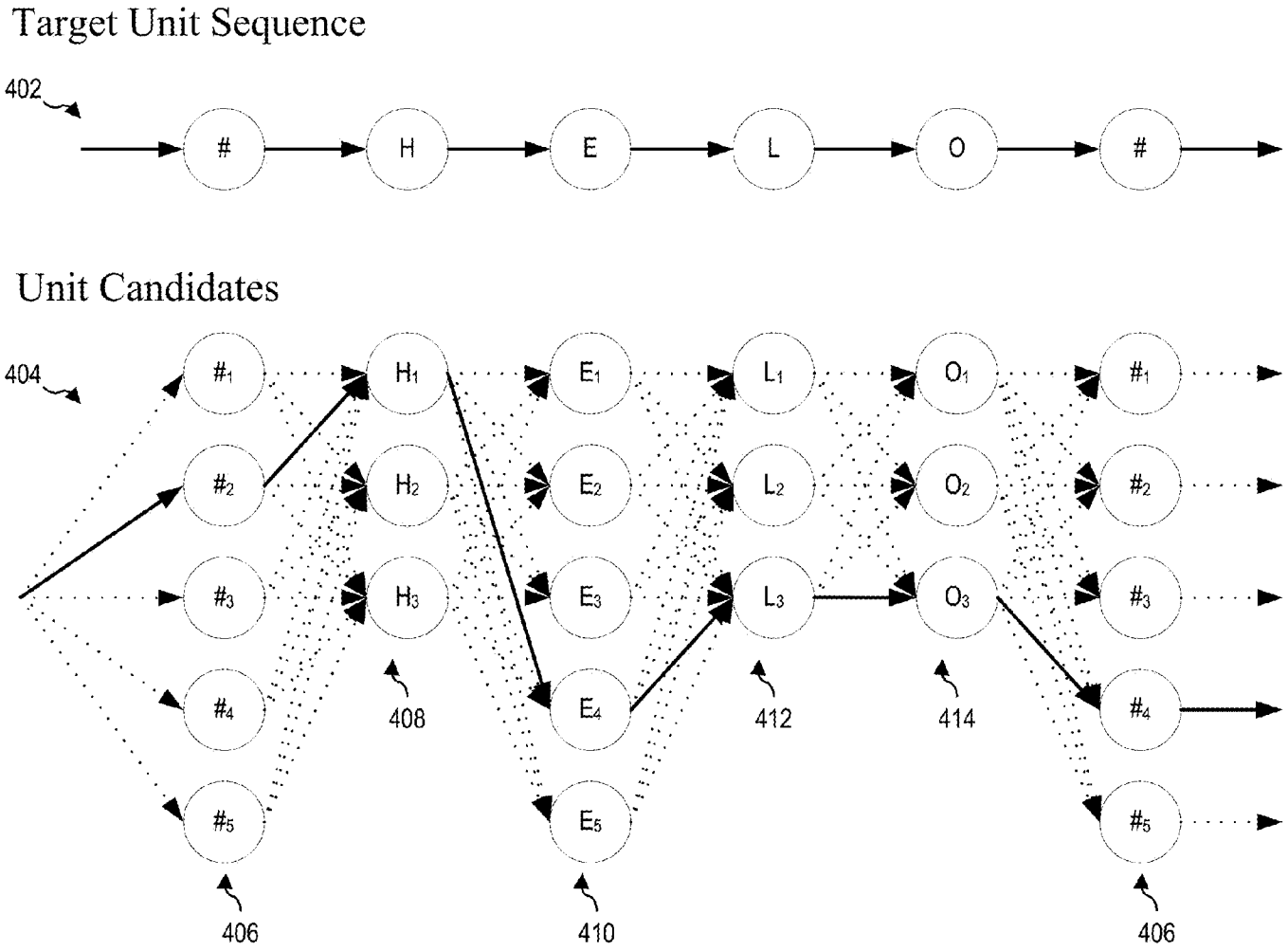

For example, as shown in FIG. 4A, a target sequence of phonetic units 402 to synthesize the word "hello" is determined by the unit selection engine 230. A number of candidate units 404 may be stored in the TTS storage 220. Although phonemes are illustrated in FIG. 4A, other phonetic units, such as diphones, may be selected and used for unit selection speech synthesis. For each phonetic unit there are a number of potential candidate units (represented by columns 406, 408, 410, 412 and 414) available. Each candidate unit represents a particular recording of the phonetic unit with a particular associated set of acoustic features. The unit selection engine 230 then creates a graph of potential sequences of candidate units to synthesize the available speech. The size of this graph may be variable based on certain device settings. An example of this graph is shown in FIG. 4B. A number of potential paths through the graph are illustrated by the different dotted lines connecting the candidate units. A Viterbi algorithm may be used to determine potential paths through the graph. Each path may be given a score incorporating both how well the candidate units match the target units (with a high score representing a low target cost of the candidate units) and how well the candidate units concatenate together in an eventual synthesized sequence (with a high score representing a low join cost of those respective candidate units). The unit selection engine 230 may select the sequence that has the lowest overall cost (represented by a combination of target costs and join costs). The candidate units along the selected path through the graph may then be combined together to form an output audio waveform representing the speech of the input text. For example, in FIG. 4B the selected path is represented by the solid line. Thus units $\#_2$, $H_1$, $E_4$, $L_3$, $O_3$, and $\#_4$ may be selected to synthesize audio for the word "hello."

The cost function(s) may include additional inputs, such as those resulting from user edits of TTS results as described below. For example, after a first pass of TTS results, a second pass of TTS processing may add inputs to the cost function(s) that push the cost function(s) toward creating new TTS results in a particular speech unit or desired speech characteristics being synthesized at a particular location.

Audio waveforms including the speech output from the TTS module 214 may be sent to an audio output device 204 for playback to a user or may be sent to the output device 207 for transmission to another device, such as another TTS device 202, for further processing or output to a user. Audio waveforms including the speech may be sent in a number of different formats such as a series of feature vectors, uncompressed audio data, or compressed audio data. For example, audio speech output may be encoded and/or compressed by an encoder/decoder (not shown) prior to transmission. The encoder/decoder may be customized for encoding and decoding speech data, such as digitized audio data, feature vectors, etc. The encoder/decoder may also encode non-TTS data of the TTS device 202, for example using a general encoding scheme such as .zip, etc. The functionality of the encoder/decoder may be located in a separate component or may be executed by the controller/processor 208, TTS module 214, or other component, for example.

Other information may also be stored in the TTS storage 220 for use in speech recognition. The contents of the TTS storage 220 may be prepared for general TTS use or may be customized to include sounds and words that are likely to be used in a particular application. For example, for TTS processing by a global positioning system (GPS) device, the TTS storage 220 may include customized speech specific to location and navigation. In certain instances the TTS storage 220 may be customized for an individual user based on his/her individualized desired speech output. For example a user may prefer a speech output voice to be a specific gender, have a specific accent, speak at a specific speed, have a distinct emotive quality (e.g., a happy voice), or other customizable characteristic. The speech synthesis engine 218 may include specialized databases or models to account for such user preferences. A TTS device 202 may also be configured to perform TTS processing in multiple languages. For each language, the TTS module 214 may include specially configured data, instructions and/or components to synthesize speech in the desired language(s). To improve performance, the TTS module 214 may revise/update the contents of the TTS storage 220 based on feedback of the results of TTS processing, thus enabling the TTS module 214 to improve speech recognition beyond the capabilities provided in the training corpus.

Figure 5:
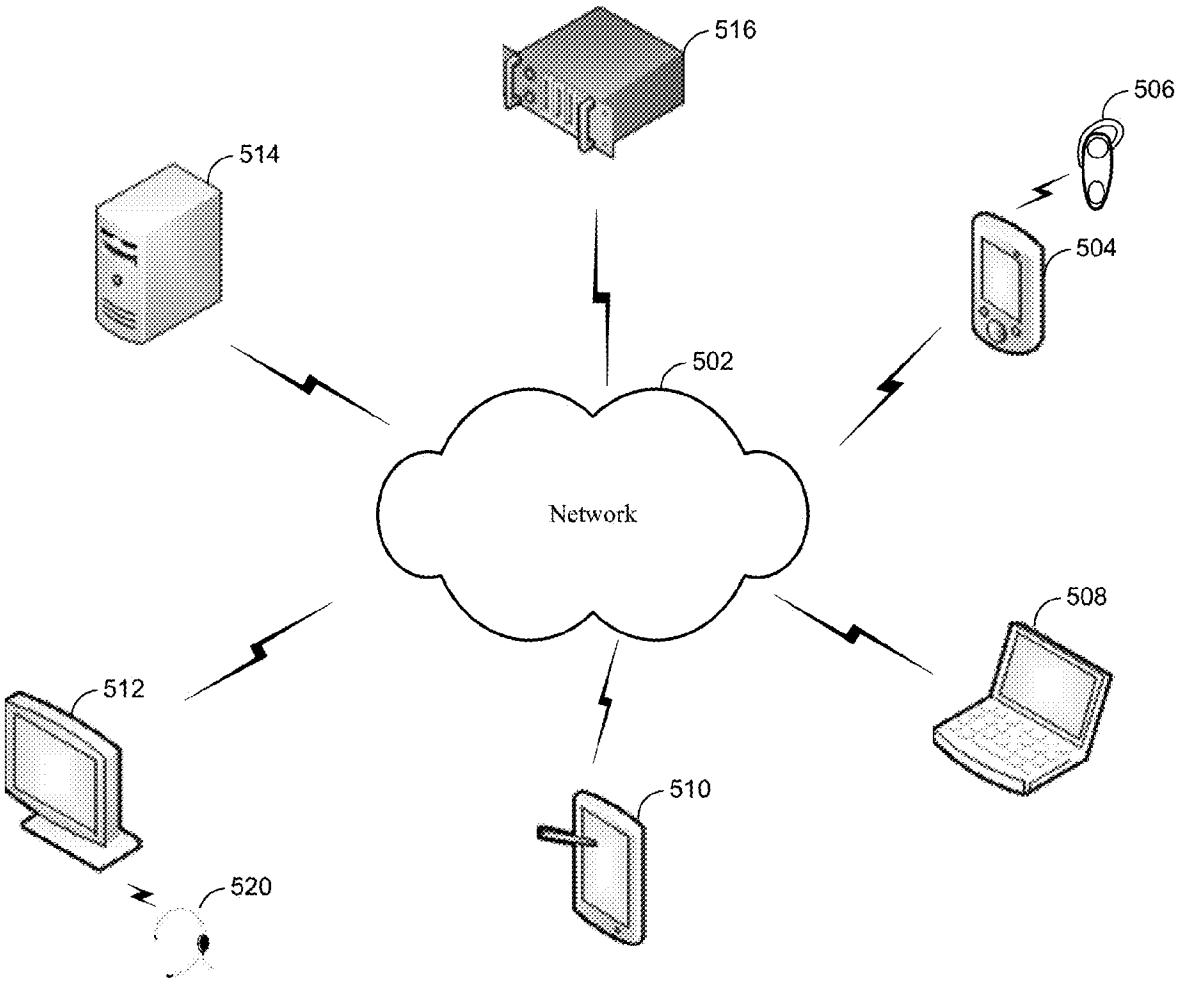
FIG. 5 illustrates a computer network for use with text-to-speech processing according to one aspect of the present disclosure.

Multiple TTS devices 202 may be connected over a network. As shown in FIG. 5 multiple devices may be connected over network 502. Network 502 may include a local or private network or may include a wide network such as the internet. Devices may be connected to the network 502 through either wired or wireless connections. For example, a wireless device 504 may be connected to the network 502 through a wireless service provider. Other devices, such as computer 512, may connect to the network 502 through a wired connection. Other devices, such as laptop 508 or tablet computer 510 may be capable of connection to the network 502 using various connection methods including through a wireless service provider, over a WiFi connection, or the like. Networked devices may output synthesized speech through a number of audio output devices including through headsets 506 or 520. Audio output devices may be connected to networked devices either through a wired or wireless connection. Networked devices may also include embedded audio output devices, such as an internal speaker in laptop 508, wireless device 504 or table computer 510.

In certain TTS system configurations, a combination of devices may be used. For example, one device may receive text, another device may process text into speech, and still another device may output the speech to a user. For example, text may be received by a wireless device 504 and sent to a computer 514 or server 516 for TTS processing. The resulting speech audio data may be returned to the wireless device 504 for output through headset 506. Or computer 512 may partially process the text before sending it over the network 502. Because TTS processing may involve significant computational resources, in terms of both storage and processing power, such split configurations may be employed where the device receiving the text/outputting the processed speech may have lower processing capabilities than a remote device and higher quality TTS results are desired. The TTS processing may thus occur remotely with the synthesized speech results sent to another device for playback near a user.

Traditional TTS processing is typically suited for converting small segments of text to speech, such as short sentences or brief statements. Examples of such short sentences include voice prompts from an automated telephone agent, audible outputs from a speech enabled kiosk, and the like. Traditional TTS is less well suited to creating speech from longer text samples, such as paragraphs, books, etc. Converting such long text into speech, called long form narration, suffers from a number of drawbacks with existing TTS systems. Existing TTS systems are usually deterministic, meaning the same input will lead to the same output. This, however, may yield unnatural sounding speech in certain instances where sentences may be repeated for effect in certain situations. Further, even with shorter synthesized speech, situations are encountered where a user would prefer if a TTS system would synthesize speech in a slightly differently to achieve the user's desired results.

Offered is a system to improve the quality of TTS results, for both long form narration as well as for other TTS operations. A TTS system may process input text into preliminary TTS results and provide a user interface, such as a graphical user interface or other suitable interface, to allow a user to edit the preliminary TTS results by adjusting acoustic features of the preliminary TTS results, by substituting phonetic units in the preliminary TTS results, or by making other edits. The user edits (or commands based on those edits) are then taken as inputs to the TTS system along with the input text for a second round of TTS results. As the user feedback is taken as an input to the TTS system, the second round of TTS results is likely to be more desirable than the preliminary TTS results.

A TTS device 202 may include a user interface module 222. The user interface module 222 may provide an interface for a TTS device to communicate with a user to display preliminary speech synthesis results, to receive feedback from a user on those results, and to incorporate that feedback to alter the speech synthesis results. The user interface module 222 may communicate directly with a TTS module 214 to provide the user's feedback (or other information based on the user's feedback) as an input to the speech synthesis engine 218 for synthesizing speech results. The TTS device may then perform iterative speech synthesis in a manner that improves results and differs from previous TTS user feedback systems. The TTS system may also track user feedback to update and train TTS processing models based on the user feedback. Such training may improve system performance so that initial TTS results may more closely match desired speech.

Figure 6:
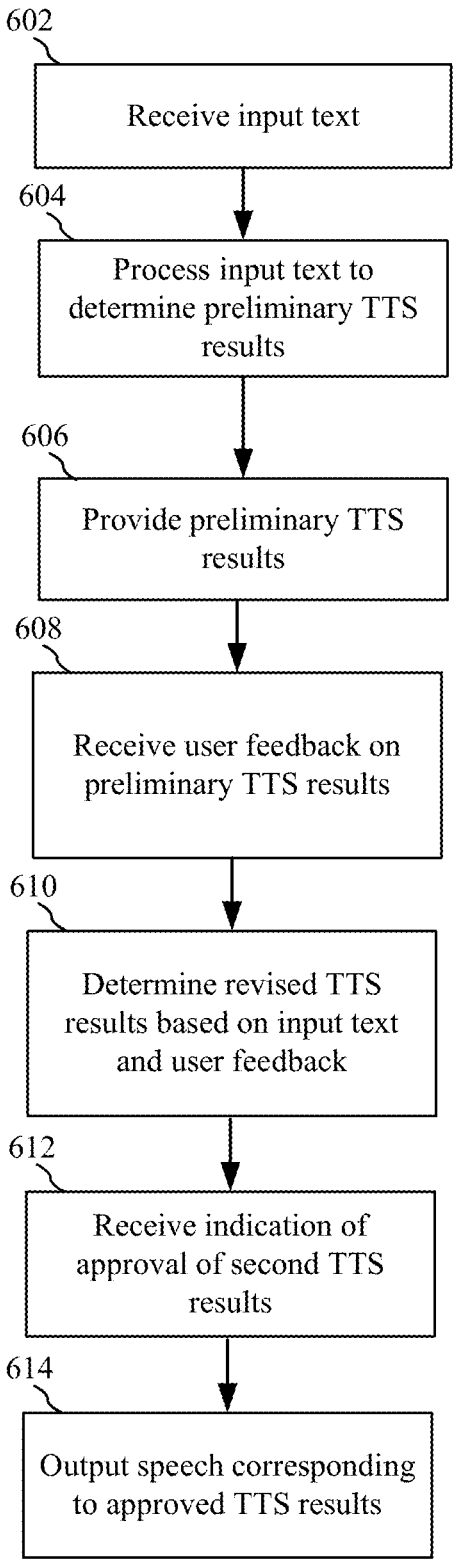
FIG. 6 illustrates a method for iterative TTS processing according to one aspect of the present disclosure.

In one aspect the user feedback and iterative speech synthesis may operate as follows and as illustrated in FIG. 6. The TTS device first receives input text for processing from any one of a variety of input mechanisms, as shown in block 602. The TTS device then processes the text to determine preliminary TTS results corresponding to the input text, as shown in block 604. The preliminary TTS results may be fully synthesized speech or a representation of synthesized speech. The representation of the synthesized speech may include a graphically displayed audio waveform representing potential synthesized speech, a series of phonetic units (such as diphones) that were selected by a unit selection engine 230 and may be used to ultimately synthesize the speech, a mapping of prosodic features for speech corresponding to the input text (such as pitch contour, power contour, etc.), or other representation. The synthesized speech may be played back to the user and/or the representation may be provided to the user through the user interface module 222 and/or other appropriate output device(s) 207, as shown in block 606.

Figure 7A:
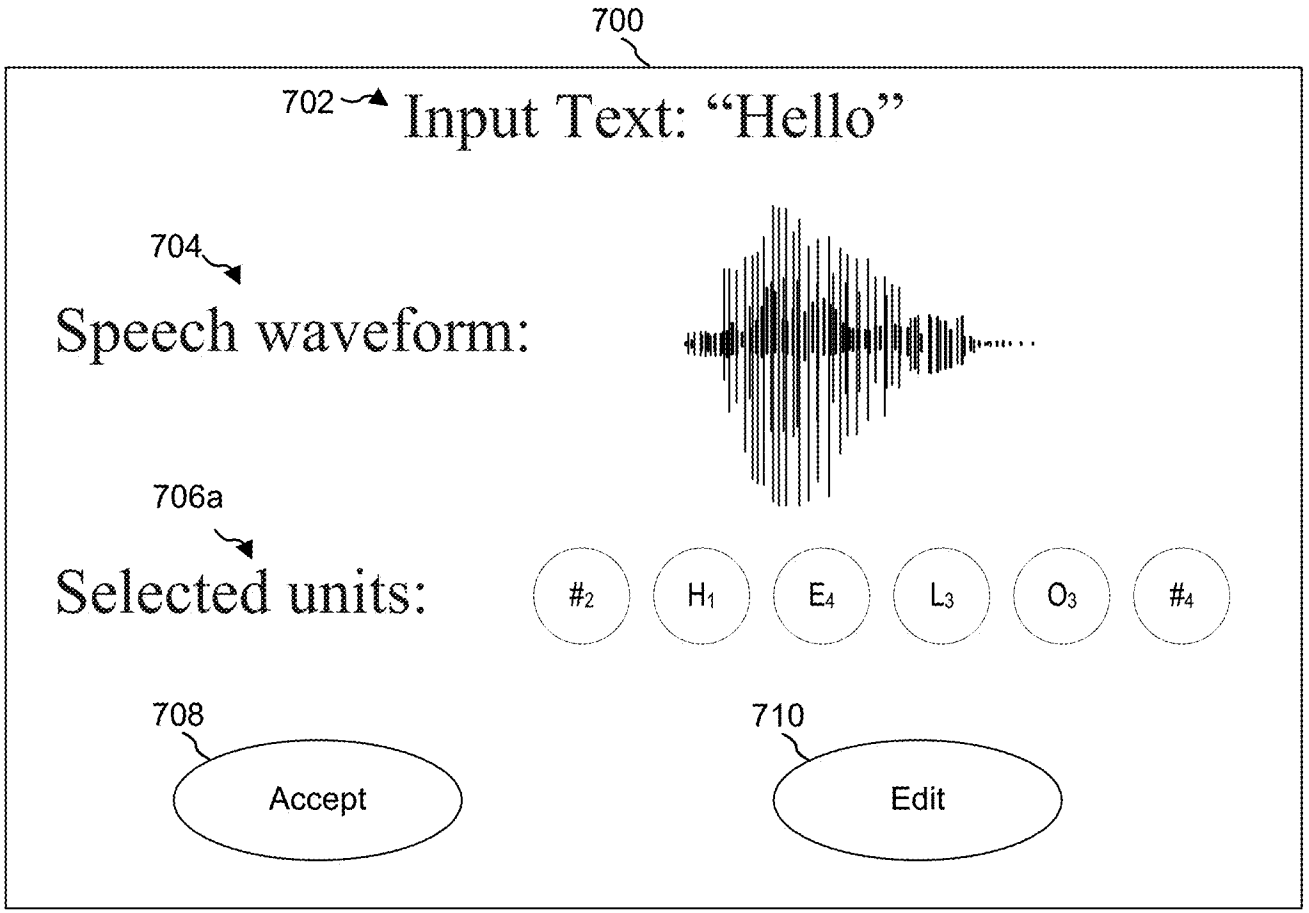
FIGS. 7A-B illustrate a user interface according to aspects of the present disclosure.

FIG. 7A shows a sample screen 700 of a user interface according to one aspect of the present disclosure where a graphical interface may be configured to provide preliminary TTS results to a user. A user interface may display TTS result to a user (entire results not shown). The user may then select a portion of the TTS results to edit. The user interface may then display the selected results to be altered in a separate screen, 700. Screen 700 displays the text 702 (illustrated as "hello") corresponding to the selected portion of the TTS results along with two representations of potential synthesized speech. One representation 704 is a proposed waveform for output speech. The other representations 706*a* are selected units that are determined by performing unit selection on the input text. The user may then have the option of accepting the preliminary TTS results (by pressing the accept button 708) or of editing the preliminary TTS results (by pressing the edit button 710).

If the user chooses to edit the preliminary TTS results the user may then suggest alterations to the preliminary TTS results. Those alterations may include adjusting the waveform, replacement of selected units with different selected units, adjusting prosodic features of preliminary TTS results, or other alterations. Prosodic features that may be adjusted include, for example, the pitch (as possibly represented by a pitch contour), the power (as possibly represented by a power contour), intonation, or other acoustic characteristic such as emotional context, narrative context or the like. Emotional context may include qualities such as the speaker sounding angry, excited, happy, sad, etc. Narrative context may include qualities such as the speaker sounding as if the text is at the beginning of a spoken passage, the end of the passage, as an aside, as part of dialog in an altered voice, etc.

In order to make such a user feedback system more robust, the voice/training corpus of the TTS system may be expanded to include a large variety of speech units (such as diphones, phonemes, etc.) that may be used to synthesize speech. For example, while a traditional corpus may include dozens of different examples of the same speech unit in different voiced context, an expanded corpus may include many dozens of different examples of the same speech unit in many more different voiced contexts. Those different examples may be cataloged according to different voiced contexts which may include different examples of corresponding prosodic features as well as different emotional contexts (happy, sad, etc.) and/or different narrative contexts. Thus, when the user is presented with the option of altering preliminary speech results, the user may select from a wide variety of potential replacement units.

In another aspect the user may provide audio feedback to the TTS device to provide the TTS device with an example of how certain selected portions of the preliminary TTS results should sound, similar to a line reading in an acting context. Thus the user may speak the input text with the same stresses, mannerisms, and other characteristics the user wishes the TTS device to emulate in the voice of the synthesized speech. The TTS device, through input device (s) 206, processor 208, and/or other components may then process the user's speech and attempt to discern the prosodic features of the user's voice so that those features may then be fed back into the TTS module 214 to refine the TTS results.

The user then determines how he/she desires to edit the preliminary TTS results and provides that feedback to the TTS device, as shown in block 608 of FIG. 6. Once the user provides feedback to the TTS device (in the form of a revised waveform, edited contour, newly selected speech unit, audible feedback, etc.), the TTS device then takes the input text and the user provided feedback to generate a second round of TTS results. To do otherwise, such as to simply perform signal processing to edit the preliminary speech results to incorporate the user feedback, may result in unnatural sounding speech as the user edits may affect other portions of the speech output that were not edited by the user, resulting in speech that would otherwise be unnatural if not reprocessed.

After receiving the user feedback, the TTS device then determines a second round of TTS results using the input text and the user feedback as inputs for the TTS processing, as shown in block 610. For example, if the user has replaced one or more units from the preliminary TTS processing with new user selected units (that likely more closely match user's desired acoustic properties for the units in question), the unit selection engine 230 may take the new user selected units as inputs, and may perform unit selection of the input text again, but this time with adjusted internal processing to ensure the user selections are included as speech units in the appropriate location. This process may continue in an iterative manner, with each round of user feedback provided as an input to the TTS device to refine multiple rounds of preliminary TTS results until the user indicates the results are acceptable, as shown in block 612 of FIG. 6. The TTS device may then output synthesized speech based on the acceptable results, as shown in block 614 of FIG. 6.

Figure 8:
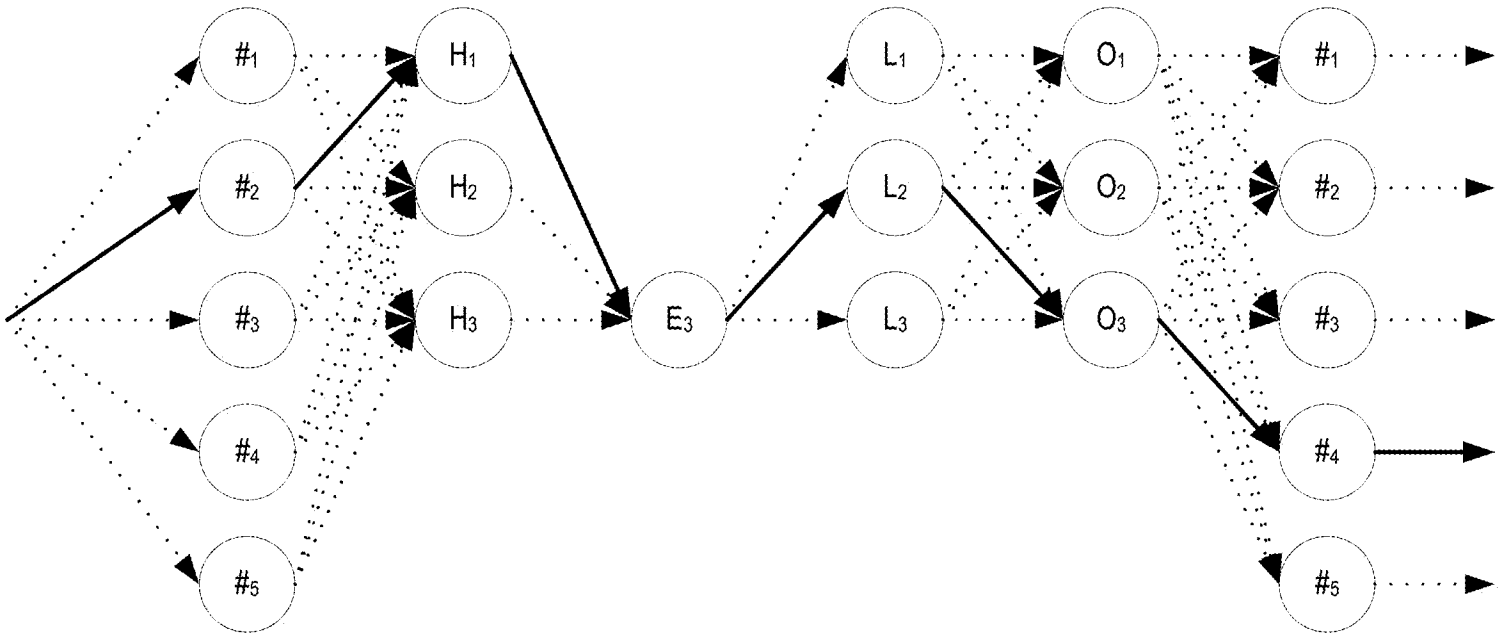
FIG. 8 illustrates unit selection according to one aspect of the present disclosure.

Continuing with the example illustrated in FIG. 7A, if the user were to edit the preliminary TTS results shown in FIG. 7A, the user may select a new speech unit to replace one or more units selected by the TTS device for the preliminary results. If, for example, the user were to replace the speech unit $E_4$ and with speech unit $E_3$, the TTS device, specifically the unit selection engine 230, would take the input text along with speech unit $E_3$ and its corresponding location in the TTS results as inputs and would re-perform the unit selection process with those inputs. The unit selection engine 230 may apply the cost function to identify and select units for the input text based on the user feedback. For example, the unit selection engine 230 may forgo the target cost function for the user selected unit, may simply indicate that unit to be used at the proper location, and may only consider the user selected unit in computing cost functions as part of the join cost to select units that will neighbor the user selected unit. For example, given the selection of $E_3$, the unit selection engine may now determine that instead of selecting $L_3$ as the unit to follow $E_3$, $L_2$ is the more appropriate unit given the different join cost. This is illustrated in FIG. 8. The unit selection engine 230 would then select $L_2$ and output the newly selected units ($\#_2$, $H_1$, $E_3$, $L_2$, $O_3$, and $\#_4$) to the user as a representation of the revised results. Other reprocessing of TTS results may occur with different forms of user feedback.

Further, a user may edit the preliminary TTS results based on various qualities that may not correspond to a single unit of speech. For example, a user may specify that a certain portion of TTS results should be adjusted based on an emotional context or quality, such as the speech sounding happier, angrier, enthusiastic, etc. These emotional qualities may also be referred to as the emotional coloring of the speech. Emotional coloring is one example of an extra segmental feature or characteristic, that is a feature of the speech that goes beyond the unit/waveform level characteristics that are typically associated with speech segments (such as pitch contour, power contour, etc.). Other examples of extra segmental features include a sentence pitch pattern, which follows the pitch of a spoken sentence, and a phrasal pitch pattern, which follows the pitch over a spoken phrase. These features track relative pitch across multiple speech segments over an entire sentence/phrase. Other extra segmental features may include dramatic features which may follow the drama of a certain portion of speech, such as the emotion, rise and fall, and narrative context associated with a longer oration (which may include qualities such as the speaker sounding as if the text is at the beginning of a spoken passage, the end of the passage, as an aside, as part of dialog in an altered voice, etc.). The extra segmental features may include changes to emphasis, rate, intonation (i.e., rising and falling pitch to match emotion), stress, etc. that correspond to the desired emotional quality of the speech, such as happiness, anger, worry, etc.

To enable the TTS system to process user edits based on emotional quality, etc., the individual units in a unit database may be tagged with information on how the particular units may fit into speech with certain emotional (or other extra segmental) qualities/features. For example, if a particular unit has a pitch contour, power contour, and length that corresponds to the unit when spoken by a speaker that is happy, the unit may be tagged as a potential unit for use in "happy" speech. A unit may be tagged as corresponding to multiple emotional features depending on if the unit may correspond to different characterizations of speech. Each unit may also be tagged with other labels that may correspond to extra segmental characteristics such as "dramatic", "emphatic speech", or the like as configured by the system.

In addition to individual units being tagged in this manner, the TTS system may be configured to apply the characteristics to certain profiles of parameters for parametric synthesis. Thus, certain parametric combinations used to construct waveforms for speech synthesis may also be tagged with similar tags corresponding to emotional features, extra segmental features, etc.

Figure 7B:
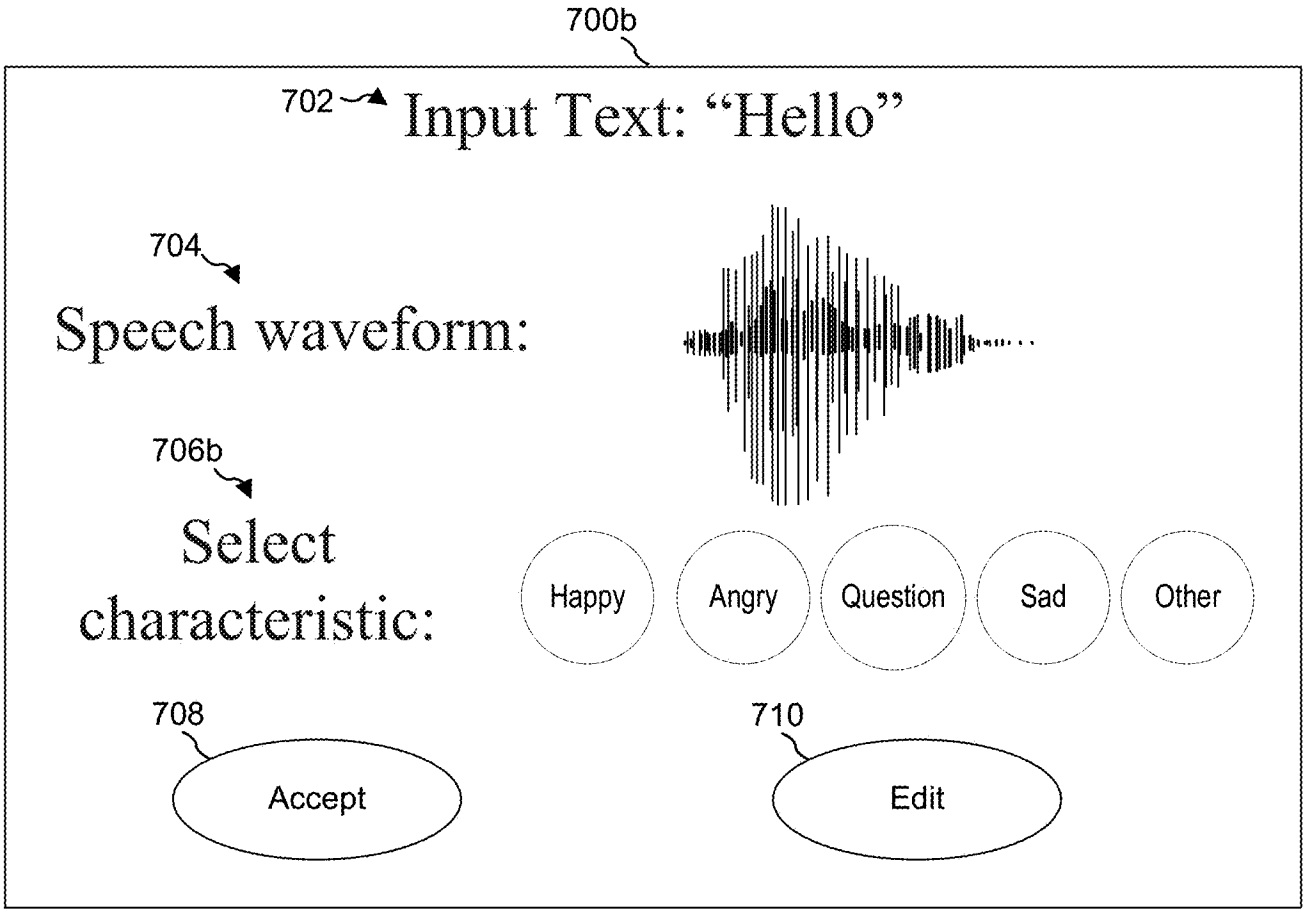

Turning again to the example of a user interface, the user interface may present a user with an option to edit TTS results, or portions thereof, according to emotional or other extra segmental characteristics. As shown in FIG. 7B, if the user selects portions of TTS results to edit, the user interface then displays a screen 700*b* showing the text 702 corresponding to the selected portion of TTS results to edit. The screen 700*b* also shows a waveform 704 for proposed output speech corresponding to the selected portion of TTS results to edit. The user may be presented with a list of potential selected characteristics 706*b* from which the user may choose to edit the selected portion of TTS results. As illustrated, the user may select the results to be modified to sound happy, angry, like a question, sad, or other. Different other options may also be provided to a user. The user may then select one or more characteristics (the user may combine characteristics, such as an angry question) and choose accept 708 and edit 710. The TTS system may then reprocess the results according to the user's selection and may take the user's selection as input for a further round of TTS processing. The TTS system may then arrive at different TTS results based on the user's selection (for example, selection of unit $E_3$ as illustrated in FIG. 8) to arrive at the new TTS results.

In one aspect, to make alteration of speech results easier to manipulate, and to improve the quality of the ultimate speech following user alteration, speech units may be stored in a database in a parametric domain rather than as time domain audio files. A voice corpus may be converted from audio files to parametric representations, such as those that may be used by a parametric synthesis engine 232. Examples of such parametric domains include STRAIGHT, TANDEM-STRAIGHT, other vocoder domains, etc. Thus each speech unit of the voice corpus is represented by a number of parameters describing the characteristics of the speech unit such as power contour, prosody, duration, etc. The parametric representations of each unit may also include characteristics that describe the emotional and/or narrative context of the speech unit. In such an aspect, where speech units are stored in a database as parametric representations a unit selection engine 230 may be used when processing long form text to identify units to be used in the synthesis and a parametric synthesis engine 232 may be used when actually generating speech from the parametric representations of the units, and may use a vocoder configured to generate speech sounding like the voice actor of the selected corpus. Thus, when creating a voice corpus, speech units in the traditional time domain (i.e., stored audio waveforms), may be converted to the vocoder domain and stored as parametric representations in the unit database.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. For example, the TTS techniques described herein may be applied to many different languages, based on the language information stored in the TTS storage.

Aspects of the present disclosure may be implemented as a computer implemented method, a system, or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid state memory, flash drive, removable disk, and/or other media.

Aspects of the present disclosure may be performed in different forms of software, firmware, and/or hardware. Further, the teachings of the disclosure may be performed by an application specific integrated circuit (ASIC), field programmable gate array (FPGA), or other component, for example.

Aspects of the present disclosure may be performed on a single device or may be performed on multiple devices. For example, program modules including one or more components described herein may be located in different devices and may each perform one or more aspects of the present disclosure. As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method of performing text-to-speech (TTS) processing, the method comprising:

receiving text including a first text portion and a second text portion;

performing unit selection on the first text portion to determine a first set of speech units representative of the first text portion;

performing unit selection on the second text portion to determine a second set of speech units representative of the second text portion;

providing preliminary TTS results to a user, the preliminary TTS results based at least in part on the first set of speech units and the second set of speech units;

receiving input data corresponding to a correction to a portion of the preliminary TTS results, the portion of the preliminary TTS results corresponding to the first text portion;

processing the input data to determine an audio characteristic corresponding to the correction;

determining a modified first set of speech units that correspond to the first text portion, wherein the modified first set of speech units corresponds to the audio characteristic and comprises a joining speech unit selected based at least in part on the second set of speech units;

determining output data using the modified first set of speech units and the second set of speech units; and causing audio corresponding to the output data to be output.

2. The computer-implemented method of claim 1, wherein the audio characteristic comprises at least one of a frequency, volume, or duration.

3. A computing system, comprising:

at least one processor;

a memory device including instructions operable to be executed by the at least one processor to perform a set of actions, configuring the computing system to:

receive text comprising a first text portion and a second text portion;

perform text-to-speech (TTS) processing on the first text portion to determine a first TTS result;

perform TTS processing on the second text portion to determine a second TTS result;

determine first output data corresponding to the first TTS result and second TTS result;

receive input data corresponding to a correction to a portion of the first output data, the portion of the first output data corresponding to the first text portion;

process the input data to determine an audio characteristic corresponding to the correction;

perform TTS processing, using the audio characteristic, on the first text portion to determine a third TTS result comprising a joining speech unit selected based at least in part on the second TTS results; and determine second output data corresponding to the third TTS result and the second TTS result.

4. The computing system of claim 3, the computing system further configured to:

send the first output data to a first device;

send the first device an instruction to display an indication of the first TTS result through a user interface; and receive the input data from the first device.

5. The computing system of claim 3, wherein:

the first TTS result comprises a first speech unit;

the computing system is configured to perform TTS processing, using the audio characteristic, on the first text portion by determining a new speech unit to replace the first speech unit; and the third TTS result comprises the at least one new speech unit.

6. The computing system of claim 5, wherein the computing system is configured to perform the TTS processing, using the audio characteristic, on the first text portion by executing a unit selection cost function wherein the new unit has a target cost of zero.

7. The computing system of claim 3, wherein the TTS processing uses a database of speech units stored in a vocoder domain.

8. The computing system of claim 3, wherein the instructions further configure the computing system to determine that the audio characteristic corresponds to a revised audio characteristic of the first TTS result.

9. The computing system of claim 3, wherein the utterance corresponds to a diphone, syllable, word, or phrase of the text.

10. The computing system of claim 3, wherein the audio characteristic comprises at least one of a frequency, volume, or duration.

11. The computing system of claim 3, wherein the audio characteristic comprises at least one of a pitch, power, intonation, emotional context, or narrative context.

12. The computing system of claim 3, the at least one processor further configured:

to determine the input data corresponds to an emotional context; and to determine the audio characteristic using the emotional context.

13. A computer-implemented method comprising:

receiving text comprising a first text portion and a second text portion;

performing text-to-speech (TTS) processing on the first text portion to determine a first TTS result;

performing first TTS processing on the second text portion to determine a second TTS result;

determining first output data corresponding to the first TTS result and second TTS result;

receiving input data corresponding to a correction to a portion of the first output data, the portion of the first output data corresponding to the first text portion;

processing the input data to determine an audio characteristic corresponding to the correction;

performing second TTS processing, using the audio characteristic, on the first text portion to determine a third TTS result representing the first text portion and comprising a joining speech unit selected based at least in part on the second TTS results; and determining second output data corresponding to the third TTS result and the second TTS result.

14. The computer-implemented method of claim 13, further comprising:

sending the first output data to a first device;

sending the first device an instruction to display an indication of the first TTS result through a user interface; and receiving the input data from the first device.

15. The computer-implemented method of claim 13, wherein:

the first TTS result comprises a first speech unit;

performing TTS processing, using the audio characteristic, on the first text portion comprises determining a new speech unit to replace the first speech unit; and the third TTS result comprises the at least one new speech unit.

16. The computer-implemented method of claim 15, performing the TTS processing, using the audio characteristic, on the first text portion comprises executing a unit selection cost function wherein the new unit has a target cost of zero.

17. The computer-implemented method of claim 13, wherein the processing uses a database of speech units stored in a vocoder domain.

18. The computer-implemented method of claim 13, further comprising determining that the audio characteristic corresponds to a revised audio characteristic of the first TTS result.

19. The computer-implemented method of claim 13, wherein the audio characteristic comprises at least one of a pitch, power, intonation, emotional context, or narrative context.

20. The computer-implemented method of claim 13, further comprising:

determining the input data corresponds to an emotional context; and determining the audio characteristic using the emotional context.

* * * * *